United States Patent [19]

Long, III

[11] 4,326,744

[45] Apr. 27, 1982

[54] WORK HOOK DEVICE

[75] Inventor: William W. Long, III, Hagerstown, Md.

[73] Assignee: Kennecott Corporation, Stamford, Conn.

[21] Appl. No.: 18,421

[22] Filed: Mar. 7, 1979

[51] Int. Cl.[3] ..... B66C 1/00

[52] U.S. Cl. ..... 294/81 R; 269/46; 294/82 R; 248/340; 15/268

[58] Field of Search ..... 269/46, 203; 51/418, 51/419, 426; 294/78 R, 82 R, 85, 81 R; 248/340, 339, 341, 222.4, 224.1, 73, 201; 15/268

[56] References Cited

U.S. PATENT DOCUMENTS

| | | | |
|---|---|---|---|
| 669,282 | 3/1901 | Lanpher | 269/203 X |
| 781,356 | 1/1905 | Peelman | 269/203 X |
| 1,447,694 | 3/1923 | Stoney | 294/81 R |
| 1,449,978 | 3/1923 | Fordyce | 248/341 X |
| 2,010,054 | 8/1935 | Brotz | 294/81 R |
| 2,526,815 | 10/1950 | Glynn | 269/46 |
| 2,942,575 | 6/1960 | Boyd | 294/81 R |
| 2,955,818 | 10/1960 | Pahl et al. | 269/203 X |
| 3,343,861 | 9/1967 | Sinicki | 294/81 R |
| 3,549,190 | 12/1970 | Caldwell | 294/81 R |
| 3,831,993 | 8/1974 | Drayton | 294/78 R |
| 3,865,422 | 2/1975 | Archer | 294/81 R |
| 3,958,825 | 5/1976 | Diamond | 294/78 R |
| 3,972,553 | 8/1976 | Johnston | 294/81 R |

*Primary Examiner*—Robert C. Watson
*Attorney, Agent, or Firm*—Charles E. Brown

[57] ABSTRACT

This invention relates to a work hook device which is particularly constructed for supporting castings as they are conveyed through a blast cleaning machine. The work hook device includes a suitable support which is of an inverted keystone cross section and which has mounted thereon one or more hooks, each of the hooks including a hanger portion and a hook portion, and the hanger portion having an opening therethrough for receiving the support, and an upper portion of the opening being of a tapered configuration for interlocking engagement with the support. The construction is such that each hook may be mounted on its associated support in a desired angular relation as opposed to being vertically disposed and so locked in that position so as to rigidly engage a workpiece to be cleaned. Normally a pair of hooks will cooperate with one another to carry a relatively large casting. Each support may be carried by a rotatable shaft so as to rotate the casting during the blast cleaning operation.

4 Claims, 8 Drawing Figures

FIG.6
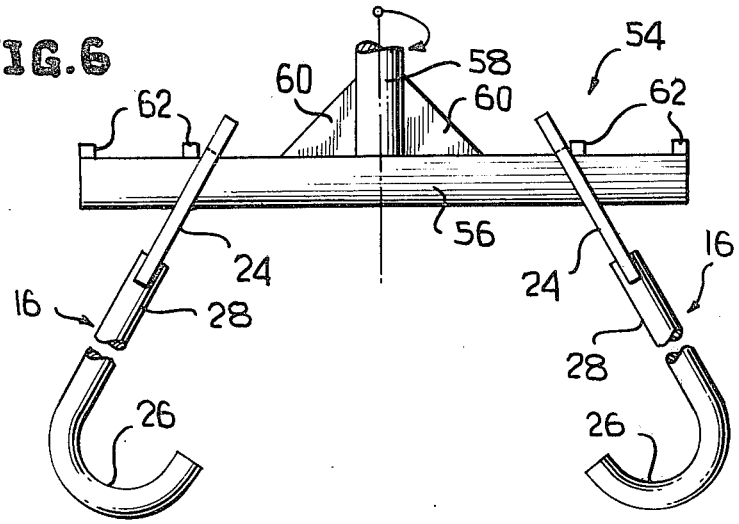
FIG.7
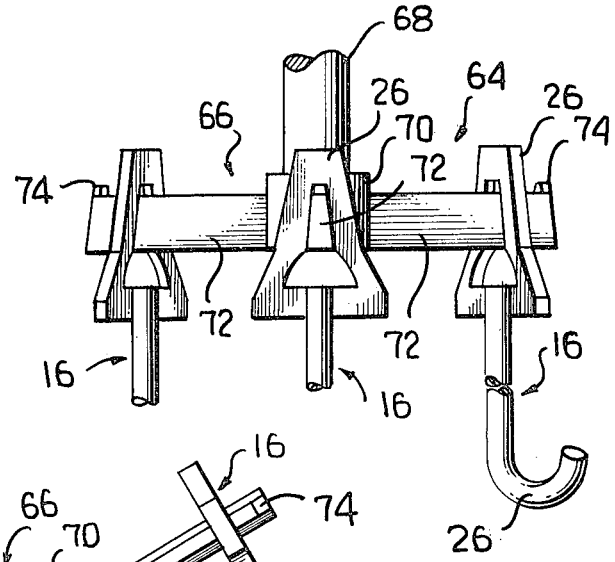
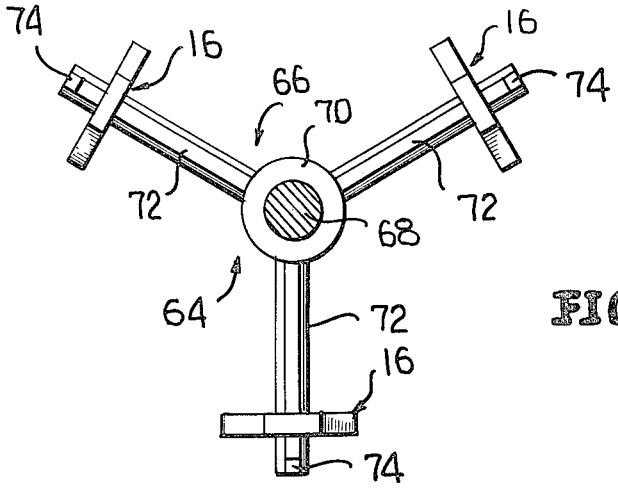
FIG.8

WORK HOOK DEVICE

This invention relates in general to new and useful improvements in hangers, and more specifically to a novel work hook device.

This invention particularly relates to a work hook device for supporting castings as they are moved through a blast cleaning machine. In the past, hooks have been mounted so that they freely swing with respect to their supports and thus offer no resistance to motion of supported castings and the like, thereby allowing conveyed workpieces to swing freely in all planes.

In accordance with this invention, there is provided a work hook device which is operable to restrict the freedom of movement of the workpiece thereby reducing adjacent casting interference and damage to the cleaning machine or workpiece during blast cleaning operations. By so rigidly mounting workpieces, the workpieces may be readily rotated within the cleaning machine so as permit the blast cleaning of all surfaces thereof.

A further benefit of the work hook device of this invention is to so mount a workpiece to be cleaned such that the workpiece is restrained and held in the abrasive blast stream throughout its cleaning cycle. By so rigidly mounting the workpiece, a more efficient cleaning operation may be effected.

Finally, although the hook is locked in place with respect to its support when the hanger portion thereof is fixedly engaged with the support, the relationship between the hanger portion and the support is such that the hooks are free for movement during the loading and unloading operations so that the locking of the hooks in position in noway interfere with the adaptability of the device to conventional loading and unloading operations.

Another feature of the invention is to provide a work hook device wherein the arrangement of the hooks on the support is such that a pair of hooks may support small workpieces having a relatively small cross section. On the other hand, the support construction may be varied so that the hooks may be spread further apart for receiving larger workpieces.

In still another form of the invention, the hooks are mounted for supporting individual workpieces.

Other objects and advantages of the invention will become apparent from the following description and illustrations found in the drawings wherein:

FIG. 6 is a front elevational view of still another form of work hook device wherein the support is in the form of a T-bar which permits for both adjustable spacing of the hooks and ease of removal thereof off the ends of the support.

FIG. 7 is a front elevational view of still another form of work hook device wherein the support includes a plurality of support arms extending in radiating relation from a central hub and there being one hook on each support arm.

FIG. 8 is a plan view of the work hook device of FIG. 7 with the support shaft being shown in section.

Figure 1:
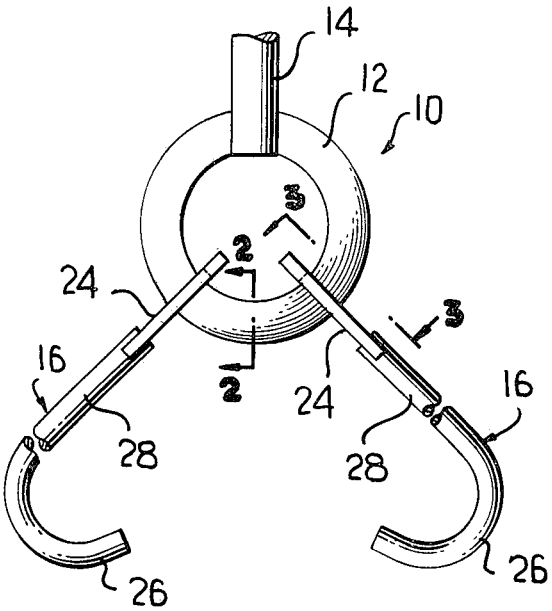
FIG. 1 is a side elevational view of a work hook device particularly constructed for fixedly supporting small objects, such as castings.
Figure 2:
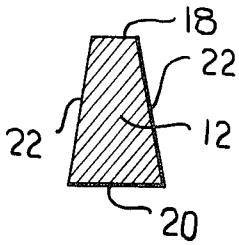
FIG. 2 is an enlarged fragmentary vertical sectional view taken generally along the line 2—2 of FIG. 1 and shows the specific cross section of the support.
Figure 3:
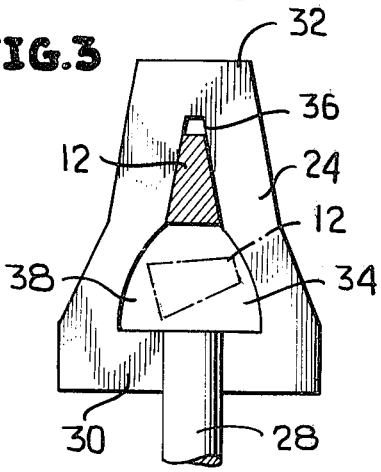
FIG. 3 is an enlarged fragmentary sectional view taken generally along the line 3—3 of FIG. 1 and shows most specifically the engagement of the hanger portion of a hook with respect to the support, the support being illustrated in a rotated position relative to the hanger portion in dotted lines.

Referring now to the drawings in detail, it will be seen that a standard work hook device formed in accordance with this invention is illustrated in FIGS. 1–3. The work hook device is generally identified by the numeral 10 and includes a support 12 which is carried by a vertical shaft 14. The support 12 carries a pair of hooks, generally identified by the numeral 16.

The illustrated support 12 is circular in outline and is of a relatively small diameter. It will be seen that the support 12 is of an inverted keystone cross section, as shown in FIG. 2. It is to be noted that the support 12 has a narrow upper or radially inner surface 18 and a wider lower or radially outer surface 20 with the cross section of the support 12 being of a regular trapezoidal cross section or that of an inverted keystone. The support 12 has sloping opposite faces 22 so that the support 12 is generally in the form of a wedge.

Figure 5:
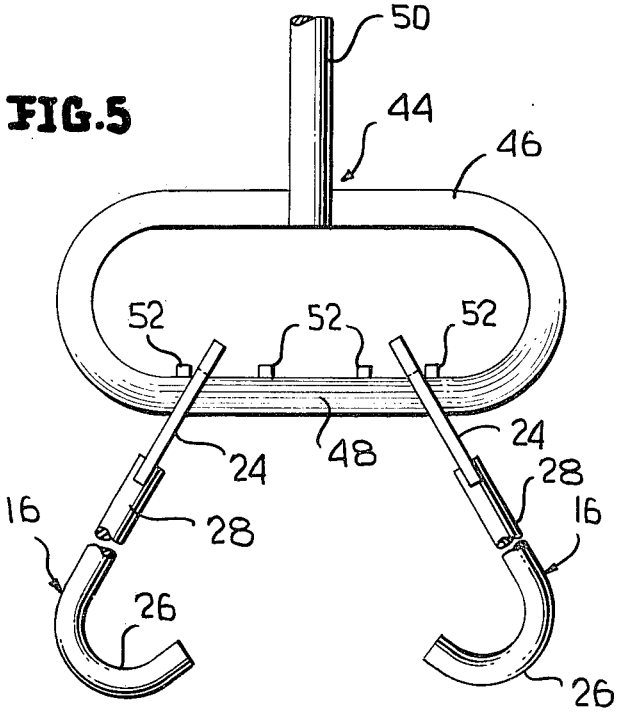
FIG. 5 is a front elevational view of a modified form of work hook device wherein the support is of an oval configuration so that the hooks may be spread further apart for the reception of larger objects or castings.

Each of the hooks 16 includes a hanger portion 24 and a hook portion 26 with each hook portion 26 including a shaft portion 28 directly coupled to the hanger portion 24. As is best shown in FIG. 5, the hanger portion 24 has the shaft 28 extending directly thereinto with the shaft 28 being fixedly secured to a base portion 30 of the hanger portion 24. The base portion 30 is substantially wider than an upper portion 32 which tapers upwardly.

The hanger portion 24 is of an outline-type configuration so as to define an opening 34. The opening 34 includes a tapered upper portion 36 having an extreme upper end which is narrower than the upper side 18 of the support 12. In this manner, when the hanger portion 24 is pulled down or radially outwardly with respect to the support 12, it will lockingly engage on the support 12 and serve to hold the hook 16 in any desired position.

The lower portion 38 of the opening 34 is of a dimension both vertically and transversely greater than the overall height of the support 12 so that once the hanger portion 24 has been moved relative to the support 12 so as to move the support 12 out of the upper portion 36 to the opening 34, the hanger portion is free to be rotated into any desired position relative to the support 12. In FIG. 3 the support 12 has been illustrated as being rotated relative to the hanger portion although normally the hanger portion will be rotated with respect to the support.

The work hook device 10 is particularly adapted for engaging a small workpiece or casting with both hook portions 26 so as to firmly grasp the small workpiece and to retain it in interlocked engagement relative to the work support 10. Thus, after the work piece or hanger has been firmly anchored on the work support device 10, and as it is moved through a blast cleaning machine, the shaft 14 may be rotated about its axis to slowly rotate the workpiece in the path of the cleaning abrasive or shot to provide for an effective overall uniform cleaning of the workpiece.

Figure 4:
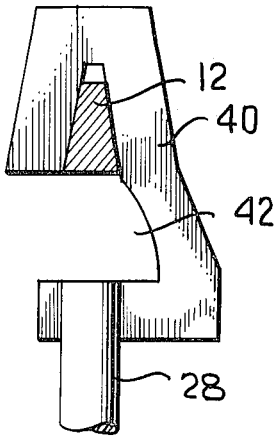
FIG. 4 is a fragmentary view similar to FIG. 3 showing a modified form of the hook portion which permits the removal of a hook from a closed loop support.

Reference is now made to FIG. 4 wherein there is illustrated a modified form of hanger portion 40. The hanger portion 40 is of the same general configuration as the hanger portion 24 except that in lieu of the hanger portion 24 being of a continuous outline, a corner part thereof has been removed so that the opening 42 therein, which corresponds to the opening 34, opens through the periphery of the hanger portion 40. Thus once the hanger portion 40 has been disengaged from the support 12, not only may the hanger portion be freely rotated with respect to the support 12, but it may be readily removed therefrom. This arrangement permits the removal and replacement of the hooks 16 on the continuous circular support 12.

Reference is now made to FIG. 5 wherein a modified form of work hook device, generally identified by the numeral 44, is illustrated. The work hook device 44 differs from the work hook device 10 in that it is provided with a support 46 which, although it is of the same cross section as the support 12, is oval in outline. The support 46 thus has an elongated lower run or bar portion 48 with which the hanger portions 24 of a pair of hooks 16 may be engaged. This permits the hooks 16 to be spaced further apart and thus permits a larger workpiece or casting to be supported by the work hook device 44.

The work hook device 44, like the work hook device 10, has the support 46 thereof suspended from a shaft 50 which is mounted for rotation so that the supported workpiece may be rotated during its passage through a blast cleaning machine.

It is also pointed out here that the lower run 48 of the support 46 may be provided with upstanding lugs 52 which are spaced at intervals. The lugs 52 provide for the accurate positioning of the hooks 16 on opposite sides of the center line of the work hook device 44. Further, when the work hook device 44 is to be repeatedly utilized for the supporting of certain workpieces, the lugs 52 may be accurately positioned for the supporting of such a workpiece.

In FIG. 6 there is illustrated still another form of work hook device, generally identified by the numeral 54. The work hook device 54 serves generally the same purpose as the work hook device 44. The work hook device 54, however, is of a T-bar construction and includes a lower horizontal bar 56 which is carried by a vertical shaft 58. The vertical shaft 58 is rigidly secured to the bar 56 by means of a pair of gussets 60.

It is to be understood that the length of the bar 56 may be varied in accordance with the size of the workpiece or casting to be supported so that the hooks 16 may be spaced apart a desired distance. The bar 56 is of the same cross section as the support 12 and the hanger portions 24 interlock with the bar in the same manner illustrated in FIG. 3.

The advantage of the T-bar construction over that of the oval support 46 is that the hanger portions 24 may be of a full construction, as shown in FIG. 3 in lieu of the skeleton construction of FIG. 4 and yet the hooks 16 may be removed off the opposite ends of the bar 56.

It is to be noted that the bar 56 is provided with lugs 62 which correspond to the lugs 52. The lugs 62 provided the same function as the lugs 52 and need not be described in more detail here.

In FIGS. 7 and 8 there is illustrated still another form of work support device which is generally identified by the numeral 64. The work support device 64 includes a support in the form of a tri-bar. The work support device 64 includes a support structure, generally identified by the numeral 66 having suspended therefrom a plurality of the hooks 16. Basically, the support structure 66 includes the usual support shaft 68 which may be mounted for rotation within a blast cleaning machine. The lower end of the shaft 68 terminates in a hub 70 having extending therefrom a plurality of bars 72. As indicated by the description of the work hook device 64, preferrably the number of bars is three although a greater number of bars may be employed.

Each bar 72 is of the same cross section as the support 12 and is shown in FIG. 2. Each bar 72 is adapted to have received thereon one outwardly facing hook 16 so that each hook 16 may carry a single workpiece or casting to be subject to an abrasive blast cleaning. In order that the hanger portions 24 may not accidentally be moved off of the ends of the bars 72, each bar 72 is provided adjacent its free end with an upstanding lug 74.

It is to be understood that each of the work support devices specifically described above may be mounted in a conventional manner on continuous conveyors for movement through a blast cleaning machine. Once the work support devices are within the blast cleaning machine, the supporting shafts thereof are rotated so as to rotate the workpiece uniformly as it passes through the abrasive or shot stream. Since the workpiece is rigidly supported, it maintains a predetermined path and there is little or no possibility of damage to the conveying system or to adjacent workpieces by undue swinging of the workpieces and the work support device carrying them.

It is to be understood that the individual components of the work hook devices will be formed of a relatively hard and high quality steel so as to not be unduly subject to erosion from the abrasive or shot stream.

Although only several embodiments of the work hook device have been specifically illustrated and described herein, it is to be understood that minor variations may be made in the work hook device without departing from the spirit and scope of the invention as defined by the apended claims.

I claim:

1. A work hook device comprising a support and a hook unit adjustably carried by said support, said hook unit including a hanger portion and a hook portion, said hanger portion being engageable over said support, and said support and hanger portion having cooperating surfaces for locking said hanger portion in an adjusted position on said support, said support having a generally trapezoidal cross section and said hanger portion having a transverse opening receiving said support with said transverse opening wedgingly receiving said support, said transverse opening being elongated in a direction opposite from that effecting wedging for faciliating release of said cooperating surfaces and movement of said hanger portion along said support, said opening including an extension of a size in two directions greater than the maximum dimension of said trapezoidal cross section to permit rotation of said hanger portion about said support.

2. The work hook device of claim 1 wherein said hanger portion has a notch opening into said extension from the exterior thereof of a size permitting the passage of said support for facilitating the mounting and removal of said hanger unit relative to said support.

3. A work hook device comprising a support and a hook unit adjustably carried by said support, said hook unit including a hanger portion and a hook portion, said hanger portion being engageable over said support, and said support and hanger portion having cooperating surfaces for locking said hanger portion in an adjusted position on said support, said support having a generally trapezoidal cross section and said hanger portion having a transverse opening receiving said support with said transverse opening wedgingly receiving said support, said generally trapezoidal cross section being of an inverted keystone shape, and said transverse opening having an upper portion of a like configuration but being elongated in relation thereto and tapering to a narrow width, and a lower portion of a height and width greater than the height of said keystone shape.

4. The work hook device of claim 3 wherein said lower portion has a flat lower boundary and convex converging side boundaries.

* * * * *